US007380613B2

(12) United States Patent
Furuta

(10) Patent No.: US 7,380,613 B2
(45) Date of Patent: Jun. 3, 2008

(54) ELECTRIC POWER TOOL

(75) Inventor: Takefumi Furuta, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 11/905,928

(22) Filed: Oct. 5, 2007

(65) Prior Publication Data

US 2008/0035360 A1 Feb. 14, 2008

Related U.S. Application Data

(62) Division of application No. 11/251,987, filed on Oct. 18, 2005, now Pat. No. 7,308,948.

(30) Foreign Application Priority Data

Oct. 28, 2004 (JP) ..... 2004-314598
Oct. 28, 2004 (JP) ..... 2004-314599

(51) Int. Cl.
*B25B 23/159* (2006.01)

(52) U.S. Cl. ..... 173/48; 173/178; 173/216

(58) Field of Classification Search ..... 173/48, 173/216, 176, 104, 109, 178
See application file for complete search history.

(56) References Cited

U.S. PATENT DOCUMENTS 4,098,351 A * 7/1978 Alessio ..... 173/13
5,056,607 A 10/1991 Sanders
5,339,908 A 8/1994 Yokota et al.
5,343,961 A 9/1994 Ichikawa
5,458,206 A * 10/1995 Bourner et al. ..... 173/178
5,842,527 A 12/1998 Arakawa et al.
6,015,017 A 1/2000 Lauterwald
6,142,242 A 11/2000 Okumura et al.
6,202,759 B1 * 3/2001 Chen ..... 173/48
6,457,535 B1 10/2002 Tanaka
6,688,406 B1 * 2/2004 Wu et al. ..... 173/48
6,745,883 B2 6/2004 Eto et al.
6,796,921 B1 9/2004 Buck et al.
6,892,827 B2 5/2005 Toyama et al.
6,983,810 B2 1/2006 Hara et al.
6,984,188 B2 1/2006 Potter et al.
7,121,361 B2 * 10/2006 Hara et al. ..... 173/176

(Continued)

FOREIGN PATENT DOCUMENTS

DE 1 628 079 A1 6/1971

(Continued)

*Primary Examiner*—Scott A. Smith
(74) *Attorney, Agent, or Firm*—Oliff & Berridge, PLC

(57) ABSTRACT

An electric power tool is provided which prevents malfunction with excellent operability even when one operation mode among various modes is selectable. In a gear case of a housing, there are provided a clutch switching groove which engages with a connecting projection of a clutch switching lever, a slit which guides a guide body having a stepped pin which penetrates an impact switching groove to engage with an auxiliary ring, and a percussion switching groove which engages with a connecting projection of a percussion switching lever. In addition, a switching case is externally provided, so that combination of sliding positions of each switching member can be changed. As the switching case can be operated by a switching button, any of all operation modes, which are, a drill mode, an impact mode, a percussion drill mode, and a clutch mode can be selected with the switching button only.

1 Claim, 10 Drawing Sheets

U.S. PATENT DOCUMENTS

| | | | | |
|---|---|---|---|---|
| 7,131,503 | B2 | 11/2006 | Furuta et al. | |
| 7,168,503 | B1 * | 1/2007 | Teng | 173/48 |
| 7,225,884 | B2 * | 6/2007 | Aeberhard | 173/93.5 |
| 2005/0173139 | A1 | 8/2005 | Furuta et al. | |

FOREIGN PATENT DOCUMENTS

| | | | |
|---|---|---|---|
| DE | 43 01 610 | A1 | 8/1994 |
| DE | 198 09 135 | A1 | 9/1999 |
| DE | 203 05 853 | U1 | 10/2003 |
| EP | 1 050 381 | A2 | 11/2000 |
| EP | 1 563 960 | A2 | 8/2005 |
| GB | 1 346 537 | | 2/1974 |
| GB | 2 274 416 | A | 7/1994 |
| GB | 2 334 911 | A | 9/1999 |
| JP | A 51-14389 | | 2/1976 |
| JP | A 2000-317854 | | 11/2000 |
| JP | A 2005-224881 | | 8/2005 |

* cited by examiner

ELECTRIC POWER TOOL

This is a Division of application Ser. No. 11/251,987 filed Oct. 18, 2005 now U.S. Pat. No. 7,308,948. The disclosure of the prior application is hereby incorporated by reference herein in its entirety.

BACKGROUND OF THE INVENTION

This application claims the benefit of Japanese Patent Application Numbers 2004-314598 and 2004-314599 filed on Oct. 28, 2004, the entirety of which are incorporated by reference.

1. Field of the Invention

The present invention relates to an electric power tool capable of applying the intermittent impact, percussion in the axial direction and the like to an anvil protruding to the front of a housing by selecting an operation mode.

2. Description of the Related Art

As an electric power tool, an impact tool described in Japanese laid-open patent application No. 2000-317854 is well known. In this application, rotation of an output shaft of a motor is transmitted to a driving shaft in a housing through a planetary gear reduction mechanism, and a hammer biased forward by a coil spring is externally provided with the driving shaft through a ball. Then, by engaging the hammer with an arm of an anvil (an output shaft) protruding to the front of the housing, rotation of the driving shaft is transmitted to the anvil through the hammer. With this structure, when a load on the anvil increases, the hammer moves backward by rolling of the ball to temporarily disengage from the arm of the anvil, and thereafter it moves forward by biasing of the coil spring to reengage with the arm. With this operation of the hammer, it is possible to apply the intermittent impact operation to the anvil (impact mode).

In addition, in this impact tool a drill mode in which impact operation by an impact mechanism is released to eliminate impact to the anvil can be selected. In a releasing means, a carrier of the last stage of the planetary gear reduction system is provided movably in the axial direction so as to be moved by an operating member from outside. The carrier is connected with a connecting member through a switching pin penetrating the center of axle of the driving shaft. The connecting member serves as a switching member which can engage with both the driving shaft and the anvil. With this configuration, the carrier is moved by the operating member to a sliding position to engage with both the driving shaft and the anvil, thereby the driving shaft and the anvil are incorporated.

On the other hand, a percussion drill having a percussion mechanism described in Japanese laid-open utility model publication No. S51-14389 is well known. In this percussion drill, a spindle (an output shaft) rotating driven by a motor is provided so as to be slightly moved back and forth in the axial direction, and the spindle is biased to a forward position by a biasing means such as a coil spring externally provided with the spindle. The spindle is provided with a first clutch which rotates integrally therewith, while a housing is provided with a second clutch into which the spindle is inserted with play for facing the first clutch. When the spindle is moved backward by pressing a bit mounted thereon, the first clutch engages with the second clutch, whereby percussion is applied to the spindle in the axial direction.

Upon mounting of the bit to the spindle, a chuck provided with the spindle is used as disclosed in the Japanese laid-open utility model publication No. S51-14389. Besides, such a structure is often used that a chuck sleeve externally mounted to the end of the spindle is provided so as to be movable back and forth with a predetermined stroke in the axial direction, and the chuck sleeve is biased to either forward or backward direction by a biasing means such as a coil spring. At the biased sliding position, a pressing member internally provided to the spindle so as to be movable in the radial direction, a ball for example, is pressed to the side of the center of axle of the spindle, thereby fixing the bit inserted into an attaching hole which is provided with the spindle. When the chuck sleeve is slid in the opposite direction against the biasing force, the pressing member pressed by the chuck sleeve is released and the bit can be mounted or detached.

In addition to the impact mode and the drill mode, a clutch mode (driver mode) can be applied to an impact tool, in which rotation transmission is stopped at a predetermined torque to an anvil. For example, this structure can be obtained by causing one of internal gears to be rotatable in the planetary gear reduction mechanism between the motor and the output shaft, and providing a pressing means for pressing the internal gear by a coil spring through a ball and a washer etc. which engage with the end of the internal gear. That is, when a load to the anvil exceeds to a biasing force of the coil spring, the internal gear is caused to idle to stop rotation transmission to the anvil.

On the other hand, besides the impact mode and the drill mode, a percussion drill mode applying percussion in the axial direction to the anvil can be applied. For example, this structure can be obtained by causing an anvil to be slightly movable back and forth and biased to a forward position in a normal state. When the anvil is at a backward position, cams provided with both the anvil and the housing engage with each other, thereby percussion is applied to the anvil.

Accordingly, when the clutch mode or percussion drill mode is applied, a switching means for switching between the drill mode and the above modes is further required. For example, in the clutch mode, a structure is applied that an operation means such as a change ring is rotated to slide the switching means which can engage with the internal gear between the engaging position and the disengaging position, so that regulation of the internal gear rotation and its release can be selected. On the other hand, in the percussion drill mode, a structure is applied that when one cam is fixed to the anvil and the other cam is made to be rotatable in the housing, a switching means which can engage with the rotatable cam is slid between the engaging position and the disengaging position by an operating means, so that percussion and its release can be selectively applied to the anvil.

When the selectable modes are thus increased, an impact switching member for switching between an impact mode and a drill mode, a clutch switching member for switching between the drill mode and the clutch mode, and a percussion switching member for switching between the drill mode and a percussion drill mode have to be separately manufactured, so that operability is deteriorated and malfunction might occur.

On the other hand, in the percussion drill mode a biasing means for biasing the spindle to a forward position and another biasing means for the chuck sleeve are separately provided. As a result, the number of parts increases and thus structure is complicated, which makes assembly troublesome and the cost high.

In view of the above, an object of the present invention is to provide an electric power tool which prevents malfunction with excellent operability even when one operation mode among various modes are selectable and in which the output shaft and the chuck sleeve are rationally biased to simplify the structure and achieve the lower cost.

SUMMARY OF THE INVENTION

In order to achieve the above object, in a first aspect of the present invention, there is provided an electric power tool including:

a housing;

a motor;

a planetary gear reduction mechanism which transmits output of the motor to an output shaft protruding to the front of an housing and rotates an internal gear;

a pressing means for pressing and fixing the internal gear;

an impact mechanism which applies an intermittent impact to the output shaft in the rotative direction;

a releasing means which arbitrarily releases the impact to the output shaft applied by the impact mechanism;

a clutch switching member which is slidable between a first sliding position to engage with the internal gear so as to regulate its rotation and a second sliding position to disengage from the internal gear so as to release the regulation;

an impact switching member which is slidable between a first sliding position to release impact by the impact mechanism with the operation of the releasing means and a second sliding position to apply impact by the impact mechanism without the operation of the releasing means, and a common switching member which simultaneously engages with both the clutch switching member and the impact switching member to slide them by its moving to a predetermined position, whereby combination of the above sliding positions is changeable, wherein by moving the common switching member from the outside of the housing, one operation mode is selectable among the following:

an impact mode where impact is applied by the impact mechanism and internal gear rotation is regulated simultaneously;

a clutch mode where impact by the impact mechanism is released and the regulation of internal gear rotation is released simultaneously, and a drill mode where impact by the impact mechanism is released and the internal gear rotation is regulated simultaneously.

In a second aspect of the present invention based on the first aspect, the electric power tool further includes:

a percussion mechanism which applies percussion to the output shaft in the axial direction;

a second releasing means which arbitrarily releases percussion to the output shaft by the percussion mechanism, and a percussion switching member which is slidable between a first sliding position to release percussion by the percussion mechanism with the operation of the second releasing means, and a second sliding position to apply percussion by the percussion mechanism without the operation of the second releasing means, wherein the percussion switching member is engaged with the common switching member so that sliding positions of the percussion switching member are combined by the operation of the common switching member, whereby the following operation mode is also selectable:

a percussion drill mode where impact by the impact mechanism is released, internal gear rotation is regulated, and percussion by the percussion mechanism is applied.

In a third aspect of the present invention, there is provided an electric power tool including:

a housing;

a motor;

a planetary gear reduction mechanism which transmits output of the motor to an output shaft protruding to the front of the housing;

an impact mechanism which applies an intermittent impact to the output shaft in the rotative direction;

a releasing means which arbitrarily releases the impact to the output shaft applied by the impact mechanism;

a percussion mechanism which applies percussion to the output shaft in the axial direction;

a second releasing means which arbitrarily releases percussion to the output shaft by the percussion mechanism;

an impact switching member which is slidable between a first sliding position to release impact by the impact mechanism with the operation of the releasing means, and a second sliding position to apply impact by the impact mechanism without the operation of the releasing means;

a percussion switching member which is slidable between a first sliding position to release percussion by the percussion mechanism with the operation of the second releasing means, and a second sliding position to apply percussion by the percussion mechanism without the operation of the second releasing means, and a common switching member which simultaneously engages with both the impact switching member and the percussion switching member to slide them by its moving to a predetermined position, whereby combination of the above sliding positions is changeable, wherein by moving the common switching member from the outside of the housing, one operation mode is selectable among the following:

an impact mode where impact is applied by the impact mechanism and percussion by the percussion mechanism is released simultaneously;

a drill mode where impact operation by the impact mechanism is released and percussion by the percussion mechanism is released simultaneously, and a percussion drill mode where impact by the impact mechanism is released and percussion is applied by the percussion mechanism simultaneously.

In a fourth aspect of the present invention based on the second or third aspect, the percussion mechanism includes a first cam which rotates integrally with the output shaft provided so as to be movable back and forth and a second cam which engages with the first cam at the backward position of the output shaft.

In a fifth aspect of the present invention based on the fourth aspect, the cutting tool further includes a biasing means for biasing the output shaft to a forward position where the first cam disengages from the second cam.

In a sixth aspect of the present invention based on the fourth aspect, with respect to the second cam provided rotatably, the second releasing means selectively moves the percussion switching means between the following sliding positions:

a first sliding position where the percussion switching means disengages from the second cam so as to allow its rotation, and a second sliding position where the percussion switching means engages with the second cam so as to regulate its rotation.

In a seventh aspect of the present invention based on the fourth aspect, the percussion switching member is a ring provided so as to be movable back and forth in a state that its rotation is regulated, the ring having engaging teeth at its front end to engage with the second cam having corresponding engaging teeth at the outer circumference thereof, and rotation of the second cam is regulated when the ring is moved to a forward position as the second sliding position.

In an eighth aspect of the present invention based on the first or third aspect, the planetary gear reduction mechanism has a speed switching member which is slidable between a connecting position in which one or more other internal gears are connected with any of carriers provided at the front and rear thereof, and a disconnecting position in which the gear(s) is disconnected from the connected carrier, and wherein the speed switching member is engaged with the common switching member so that sliding positions of the speed switching member are combined by the operation of the common switching member, whereby speed can be switched in an arbitrary operation mode.

In a ninth aspect of the present invention based on the eighth aspect, the speed switching member is a ring provided in a state that its rotation is regulated, the ring axially supporting said one or more other internal gears so as to be movable with the same back and forth in the axial direction.

In a tenth aspect of the present invention based on the first or third aspect, the common switching member is formed from a switching case provided at the outer circumference of the gear case accommodating the planetary gear reduction mechanism and the impact mechanism, the switching case being moved by the operation of a switching button exposed to the outer side of the housing, and wherein each switching member is moved in the switching case by means of the following:

a unidirectional restricting slit provided at either the gear case or the switching case;

a switching groove provided at the other thereof in a different direction from the restricting slit, and a connecting body provided at either the switching case or the switching member and penetrating both the restricting slit and the switching groove, whereby the switching member is slid along the restricting slit guided by the switching groove in accordance with the moving of the switching case.

In an eleventh aspect of the present invention based on the tenth aspect, the switching case is a semi-cylindrical body to which the switching plate having the switching button is fitted and which rotates integrally with the switching plate along sliding of the switching plate in the circumferential direction of the gear case.

In a twelfth aspect of the present invention based on the first or third aspect, the impact mechanism comprises:

a spindle coaxially disposed with the output shaft and to which rotation of the motor is transmitted;

a hammer externally provided with the spindle and having an engaging portion to engage with the output shaft;

a coil spring which biases the hammer to an engaging position with the output shaft;

a cam groove provided at the inner surface of the spindle or the hammer so as to be inclined from the axial direction, and a ball fitted to the cam groove to connect the spindle and the hammer and allowing the backward movement of the hammer by rolling in the cam groove.

In a thirteenth aspect of the present invention based on the twelfth aspect, the releasing means comprises an auxiliary ring externally provided on the hammer so as to be rotatable integrally as well as movable in the axial direction, and having an auxiliary portion being attached to an engaging portion of the hammer, and wherein the auxiliary ring is selectively moved to either a forward position where it engages with the output shaft, or a backward position where it disengages from the output shaft.

In a fourteenth aspect of the present invention based on the twelfth aspect, the output shaft has an arm at the rear thereof protruding in the radial direction to be engaged with the engaging portion of the hammer and the auxiliary portion of the auxiliary ring.

In a fifteenth aspect of the present invention based on the first aspect, the biasing force to the internal gear by the pressing means is changeable.

In a sixteenth aspect of the present invention based on the first aspect, the clutch switching member is a ring externally provided with the internal gear at the outer circumference thereof so that it is movable back and forth in the axial direction in a state that its rotation is regulated, and the ring engages with the internal gear at a forward position to regulate its rotation.

In a seventeenth aspect of the present invention based on the tenth aspect, the impact switching member is a guide body accommodated in the switching case so as to be movable back and forth, and the guide body penetrates the switching groove formed in the gear case to engage with the releasing means.

In an eighteenth aspect of the present invention, there is provided an electric power tool including:

a housing;

a motor;

an output shaft which rotates driven by the motor and protrudes so as to slightly move back and forth in the axial direction, the output shaft having an attaching hole for a bit at the top thereof;

a percussion mechanism provided in the housing for applying percussion to the output shaft in the axial direction at a backward position of the output shaft;

a pressing member provided in the output shaft so as to be movable in the radial direction, and a chuck sleeve provided at the top of the output shaft so as to be movable back and forth in the axial direction with a predetermined stroke as well as biased to one sliding position either forward or backward by a biasing means, and the chuck sleeve presses the pressing member to the side of the center of axle of the output shaft at the sliding position so that the bit inserted into the attaching hole is fixed, wherein the biasing means is set to press the chuck sleeve so as to be slid backward and at the sliding position the chuck sleeve is caused to abut to the side of the housing, resulting that the output shaft is biased to a forward position by the biasing means.

In a nineteenth aspect of the present invention based on the eighteenth aspect, the pressing member is a ball.

According to the present invention, any of all operation modes can be selected by operating a common switching means. Accordingly, malfunction can be prevented and operability and reliability can be excellent.

Moreover, adding the percussion drill mode does not deteriorate operability, so that an excellent operability can be maintained.

Further, since a common switching means is also used for switching speed, a more excellent operability can be expected.

Still further, each switching member can be surely slid to a sliding position smoothly.

Still further, biasing the output shaft to a forward position as well as the chuck sleeve to a backward position can be achieved by using one biasing means, which reduces the number of parts and achieves an efficient structure. Therefore, the trouble of assembly can be saved and the manufacture cost can be reduced.

DETAILED DESCRIPTION OF THE PREFERRED EMBODIMENTS

Hereinafter, a preferred embodiment of the present invention will be explained with reference to the drawings.

Figure 1:
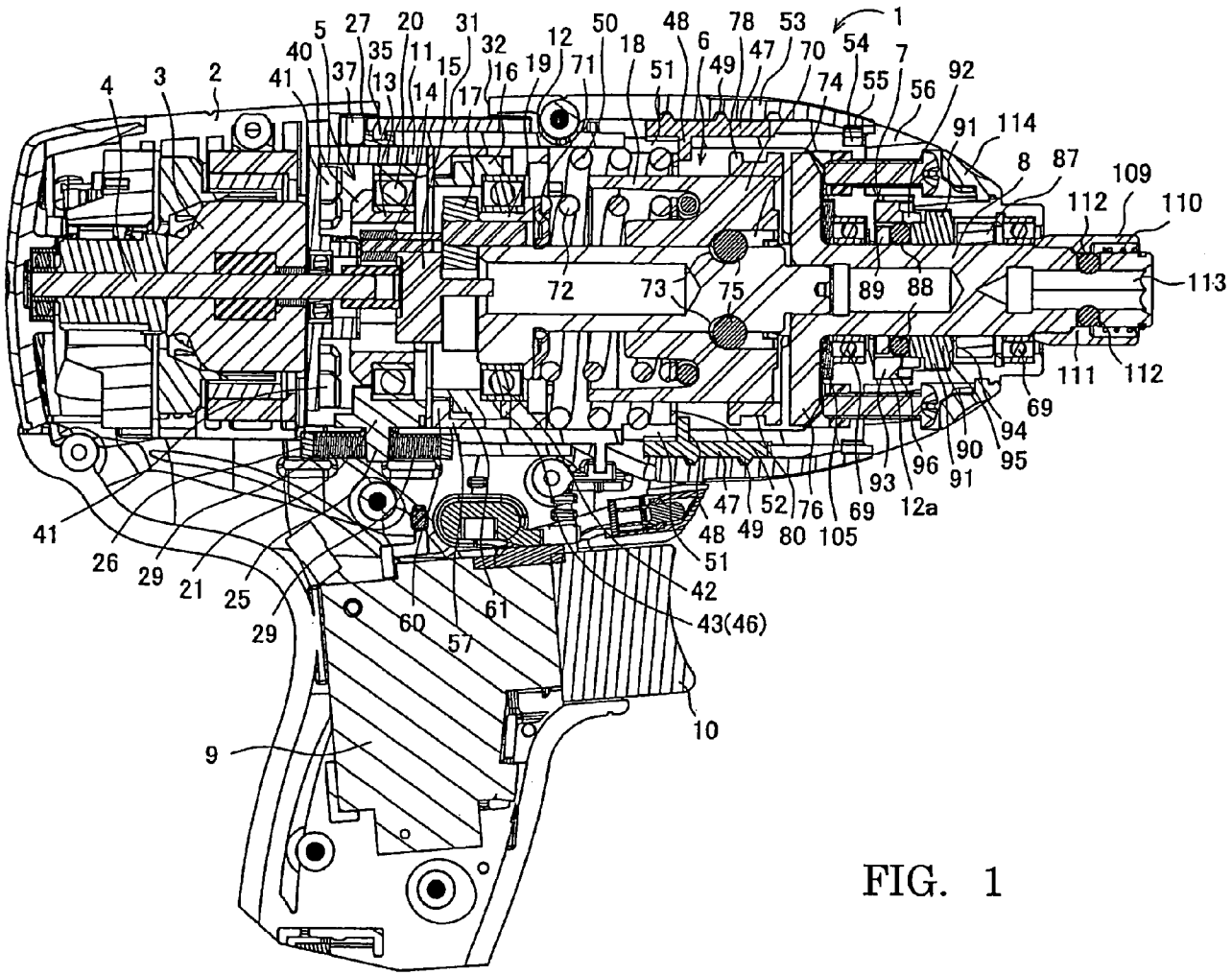
FIG. 1 is a vertical section view of an impact driver.

FIG. 1 is a vertical section view of an impact driver as an example of an electric power tool. An impact driver 1 has a motor 3 accommodated at the rear of a body housing 2 formed of a pair of right and left half-housings. (Here, the right direction of FIG. 1 is forward.) In front of the motor 3, a planetary gear reduction mechanism 5 with a clutch mechanism, an impact mechanism 6 and a percussion mechanism 7 are respectively provided, and an anvil 8 coaxially provided with a motor shaft 4 of the motor 3 is protruding at the front end. The reference number 9 denotes a switch of a driving circuit for the motor 3, and the reference number 10 denotes a trigger for turning ON the switch 9 when the trigger is pressed.

Figure 2:
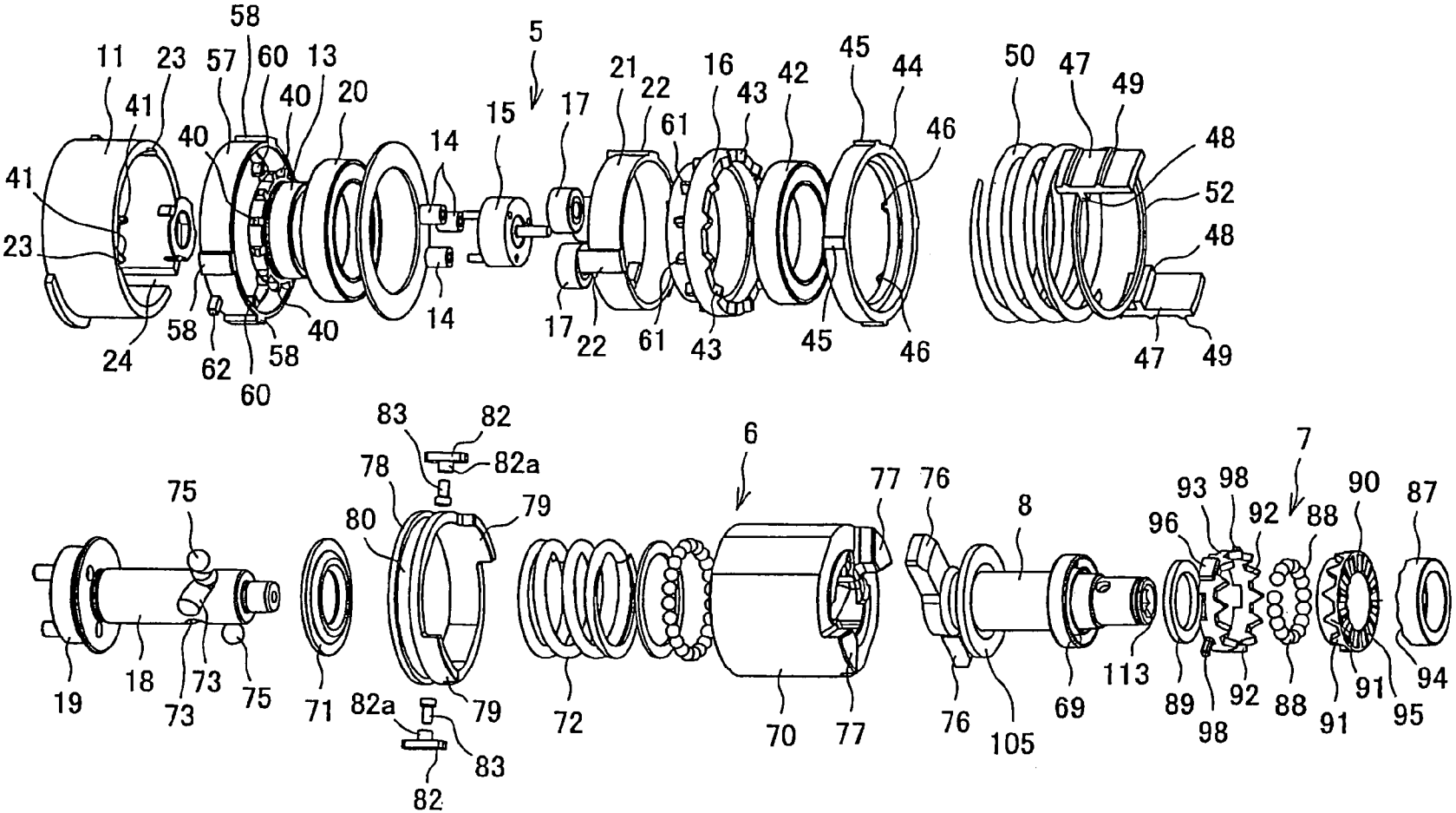
FIG. 2 is an exploded perspective view of an internal mechanism.
Figure 3:
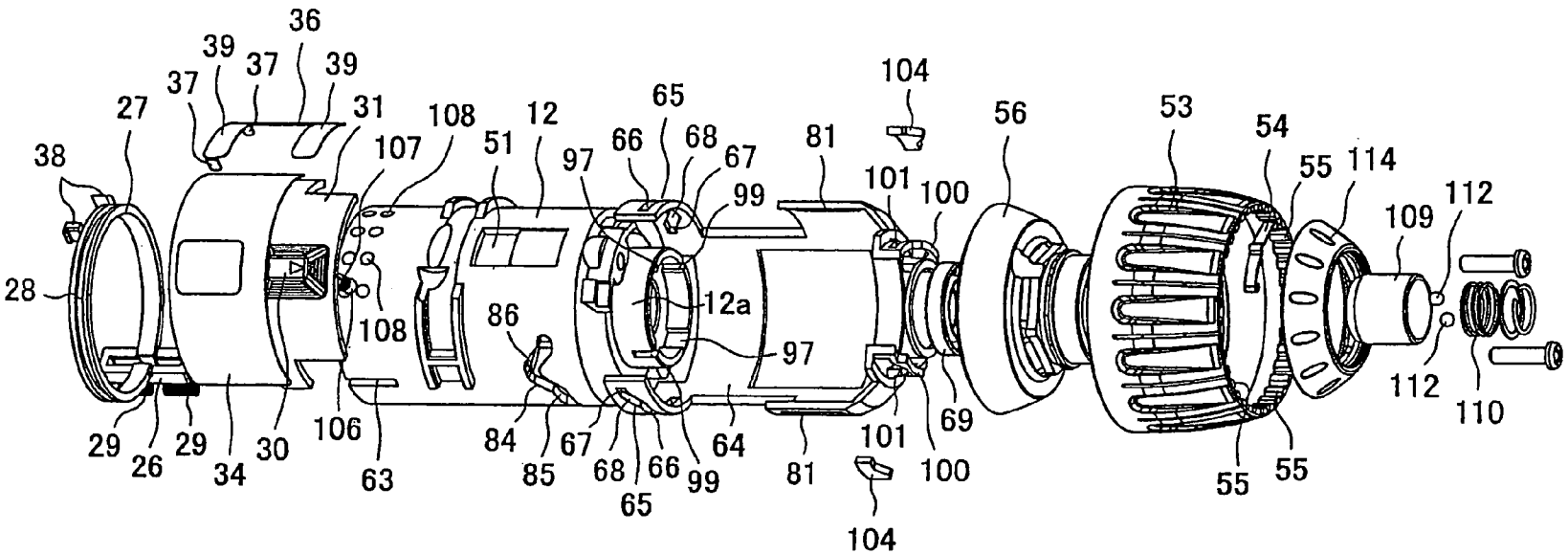
FIG. 3 is an exploded perspective view of an internal mechanism.

As shown in FIGS. 2 and 3, the planetary gear reduction mechanism 5 is housed between a cylindrical motor bracket 11 and a gear case 12. The motor bracket 11 is fixed in the body housing 2 and axially supports the motor shaft 4. The gear case 12 is connected in front of the motor bracket 11 and formed in a cylindrical shape having a slightly larger diameter than the motor bracket 11. That is, the planetary gear reduction mechanism 5 includes three planetary gears 14, 14 . . . , a carrier 15, three planetary gears 17, 17 . . . and a spindle 18. The planetary gears 14, 14 . . . engage with a pinion fitted on the motor shaft 4 and are rotatable in a first internal gear 13. The carrier 15 supports the planetary gear 14. The planetary gears 17, 17 . . . engage with an output shaft portion in front of the carrier 15 and are rotatable in a second internal gear 16 as the next layer. The spindle 18 has a carrier portion 19 supporting the planetary gear 17 and is coaxially inserted into the rear surface of the anvil 8 with play. With this configuration, the rotation speed of the motor shaft 4 can be transmitted to the spindle 18 with two-staged reduction.

Figure 5B:
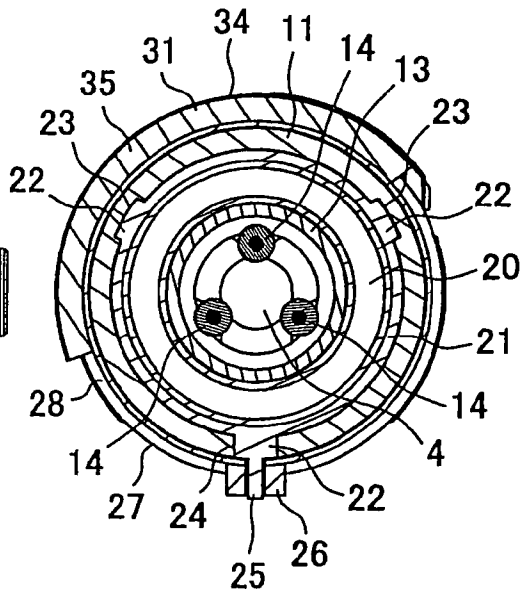
FIG. 5B is a sectional view taken along line A-A.

Here, the first internal gear 13 is axially supported so as to be rotatable by a ball bearing 20 in the motor bracket 11. As shown in FIG. 5B, a speed switching ring 21 (a speed switching member) supporting the ball bearing 20 is movable back and forth in the axial direction. In addition, the speed switching ring 21 is regulated its rotation by engagement of the three projections 22, 22 . . . provided outwardly in the axial direction at the outer circumference of the speed switching ring 21 with respect to two guide grooves 23, 23 and a slit 24 provided with a concavity corresponding to the projections 22, 22 . . . in the motor bracket 11. Among the three projections 22, 22 . . . of the speed switching ring 21, one projection 22 engaging with the slit 24 has a connecting piece 25 protruding in the radial direction and inserted with play into a rectangular frame 26 provided at the outside of the motor bracket 11. The frame 26 is externally provided on the motor bracket 11 and orthogonally connected to a ring-shaped speed switching lever 27 which is provided so as to move back and forth between a forward position where the switching lever 27 abuts to the rear end of the gear case 12 and a backward position where it abuts to a step portion provided on the inner surface of the body housing 2. At the outer circumference of the speed switching lever 27, a concave groove 28 is provided in the circumferential direction except a portion of a frame 26. In the frame 26, coil springs 29, 29 are internally provided back and forth so as to sandwich the connecting piece 25.

Figure 4:
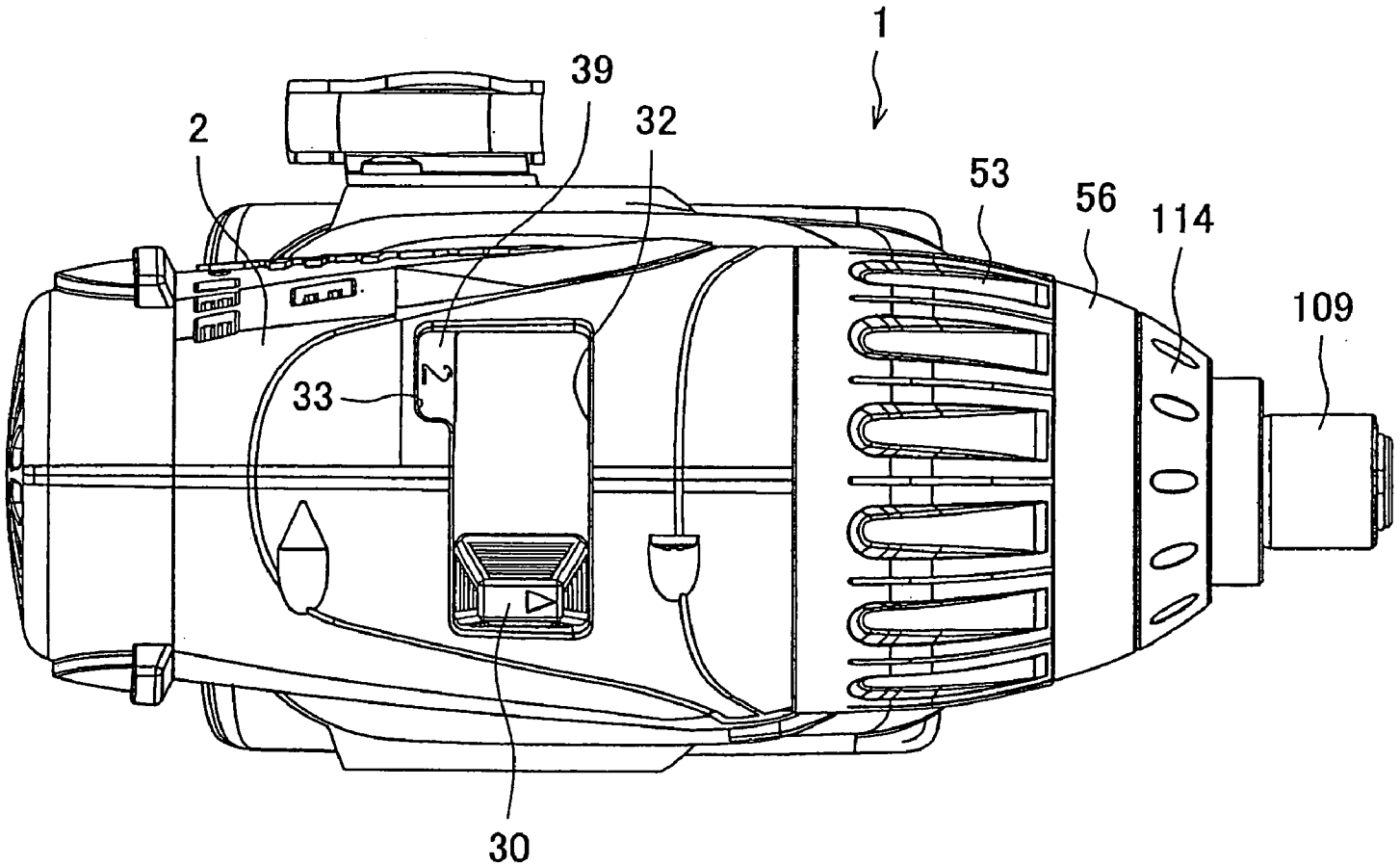
FIG. 4 is a plain view of an impact driver.

On the other hand, at the outer circumference of the gear case 12, a curved switching plate 31 having a switching button 30 at the top thereof is provided. As shown in FIG. 4, the switching plate 31 exposes the switching button 30 through a rectangular window 32 provided on the top of the body housing 2 in the lateral direction. The switching plate 31 is movable in the circumferential direction of the gear case 12 regulated within the range of movement of the switching button 30 in the window 32. At the left end of the window 32 a retracting portion 33 in which the switching button 30 can move backward is integrally provided, so that when the switching button 30 is slid at the left end into the retracting portion 33, the switching plate 31 is moved backward. On the switching plate 31, a thin rectangular protecting plate 34 exposing only the switching button 30 is set. The protecting plate 34 always covers the entire surface of the window 32 to prevent dust from intruding irrespective of each sliding position of the switching button 30.

At the inner surface of the switching plate 31, a connecting projection 35 inserted into a concave groove 28 of a speed switching lever 27 is projecting, whereby the speed switching lever 27 can follow the back-and-forth movement of the switching plate 31. Similarly, between the body housing 2 and the protecting plate 34, an indicating plate 36 having an open-boxed shape in a plain view is set. The indicating plate 36 has folding pieces 37, 37 protruding in the downward direction formed at rear lateral ends to be locked at the outer side of a pair of L-shaped stopper pieces 38, 38 formed on the rear upper end of the speed switching lever 27. With this configuration, the switching button 30 can engage with the indicating plate 36 at the left end of the window 32. The indicating plate 36 contributes to connection between the speed switching lever 27 and the switching plate 31, while it enables indicating pieces 39, 39 positioned both in front and rear of the switching button 30 to be exposed in the window 32 alternatively in accordance with the forward or backward position of the switching button 30 for achieving recognition of the numbers appearing on the surface.

According to the above, when the switching button 30 is operated at the left end of the window 32 to move the switching plate 31 back and forth, the speed switching ring 21 and the first internal gear 13 move back and forth accordingly through the speed switching lever 27. Here, when the speed switching ring 21 and the first internal gear 13 are located at a forward position, they engage with the planetary gear 14 and the carrier 15 in the first layer simultaneously. On the other hand, when the speed switching ring 21 and the first internal gear 13 are located at a backward position, they engage with only the planetary gear 14 and disengage from the carrier 15. At the rear circumference of the first internal gear 13, engaging teeth 40, 40 . . . protrude with an even interval in the circumferential direction. At the backward position of the first internal gear 13, the engaging teeth 40, 40 . . . engage with engaging teeth 41, 41 . . . protruding at the bottom of the motor bracket 11 to regulate the rotation of the first internal gear 13. Consequently, at the backward position of the internal gear 13 the rotation speed of the motor shaft 4 of the motor 3 is transmitted to the carrier 15 with reduction by means of the planetary gear 14 which orbitally rotates in the first internal gear 13. This causes a slow mode in which two-staged speed reduction is conducted by the planetary gear reduction mechanism 5. At the forward position of the first internal gear 13, a high speed mode can be obtained in which the rotation of the motor shaft 4 is directly transmitted to the carrier 15.

Here, at a forward position of the switching button 30, the indicating plate 36 exposes the rear indicating piece 39 on the retracting portion 33 of the window 32 to exhibit the number "2" showing the high speed mode. On the other hand, at a backward position of the switching button 30, the indicating plate 36 exposes the front indicating piece 39 in the window 32 to exhibit the number "1" showing the slow mode. Moreover, the first internal gear 13, the carrier 15 and the engaging tooth 41 might be misaligned when the first internal gear 13 is slid to engage with the others. Even in this case, the switching operation can always be conducted smoothly because the speed switching lever 27 is moved to an appropriate position by means of elastic deformation of the coil springs 29, 29. In this case, since the switching lever 27 is kept biased by the coil spring 29, the first internal gear 13 and the speed switching ring 21 are slid back and forth to be located at an appropriate position engaging with each other appropriately when the motor shaft 4 rotates.

The second internal gear 16 is provided in the gear case 12 so as to be rotatable holding a ball bearing 42 which axially supports a carrier 19 of the spindle 18. At the front surface of the second internal gear 16, engaging projections 43, 43 . . . with lateral sides sloped in the circumferential direction are positioned with even intervals in the circumferential direction. In front of the second internal gear 16, a pressing ring 44 is provided so as to be movable in the axial direction. The pressing ring 44 is regulated its rotation by engagement between projections 45, 45 . . . formed on the outer surface of the pressing ring 44 in the axial direction and a concave groove (not shown) provided on inner surface of the gear case 12. In the pressing ring 44, engaging projections 46, 46 . . . having the same shape as the engaging projections 43, 43 . . . for engaging with each other are provided with even intervals in the circumferential direction on the rear surface opposing to the second internal gear 16. In front of the pressing ring 44, a coil spring 50 whose front end is received by a pair of pushers 47, 47 is provided so as to press the pressing ring 44 backward. The pushers 47, 47 are plates provided at the outer surface of the gear case 12 symmetrically disposed to the axis for protruding stopper pieces 48, 48 provided on inner surface of the pusher 47 into the gear case 12 through openings 51, 51 formed in the gear case 12. The stopper pieces 48, 48 receive the front end of the coil spring 50 through a washer 52. On the outer surface of the pushers 47, 47, a male screw portion 49 is formed respectively.

With this configuration, the second internal gear 16 is regulated its rotation being pressed and fixed by the coil spring 50 and the pressing ring 44 which serve as a pressing means. On the gear case 12 provided in front of the body housing 2, a cylindrical change ring 53 having a female screw portion in its inner circumference is externally provided so as to be rotatable. The change ring 53 engages with the male screw portion 49 of the pushers 47, 47. Consequently, when the pushers 47, 47 are screwed in the axial direction by rotating operation of the change ring 53, biasing force on the pressing ring 44 can be changed by contracting or expanding the coil spring 50 in the axial direction. At the front end outer circumference of the gear case 12, a leaf spring 54 is fitted. The leaf spring 54 engages with internal teeth 55, 55 . . . formed at the top inner circumference of the change ring 53. Accordingly, click operation can be obtained when the change ring 53 is rotated. The reference number 56 denotes a hammer case screwed to be fixed to the gear case 12 in front of the change ring 53 and axially supporting the anvil 8. The hammer case 56, the body housing 2, and the change ring 53 serve as a housing of the present invention. A ring-shaped bumper 114 made of rubber is provided in front of the hammer case 53 serving as a blinder for a screw portion as well as a protector of a material to be processed from damage caused by abutment with the front portion of the impact driver 1.

Figure 6C:
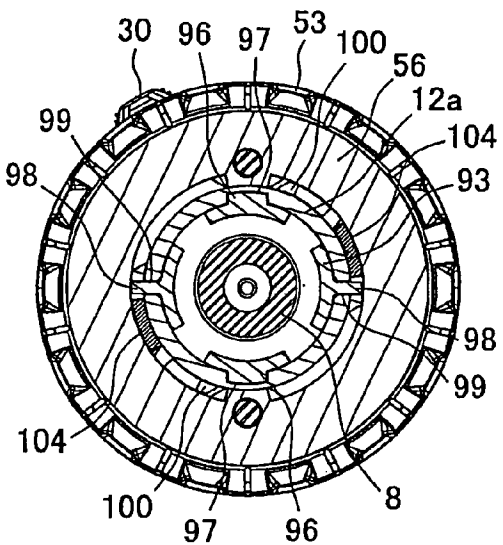
FIG. 6C is a sectional view taken along line D-D.
Figure 6B:
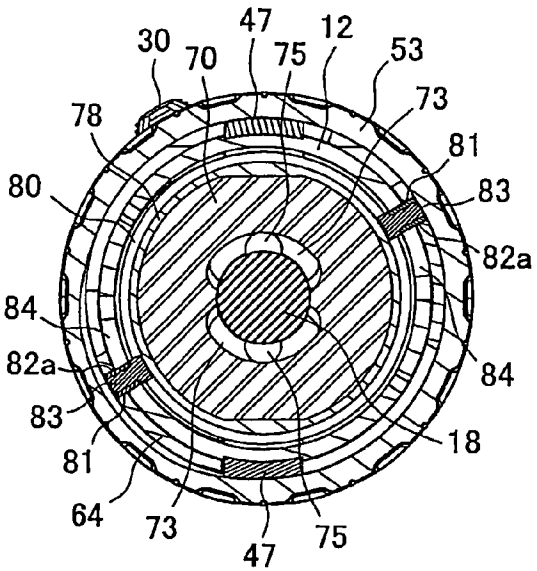
FIG. 6B is a sectional view taken along line C-C.
Figure 6A:
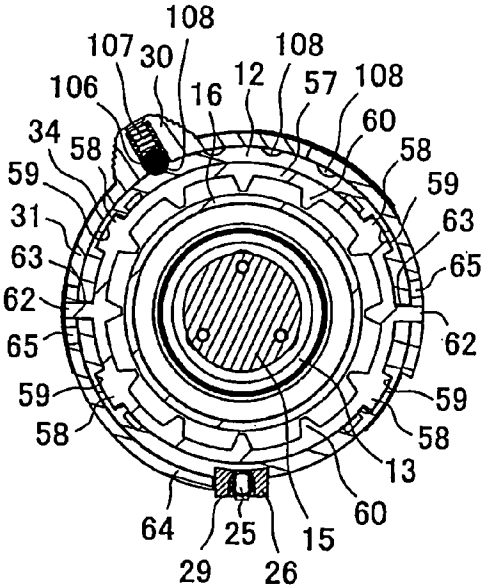
FIG. 6A is a sectional view taken along line B-B.

As shown in FIG. 6A, at the outer circumference of the second internal gear 16, a ring-shaped clutch switching lever 57 (a clutch switching member) is externally provided so as to be movable back and forth in the axial direction. The clutch switching lever 57 is regulated the rotation by engagement between projections 58, 58 . . . provided at the outer circumference of the clutch switching lever 57 in the axial direction and concave grooves 59, 59 . . . provided at the rear end inner circumference of the gear case 12. At a forward position of the clutch switching lever 57, engaging teeth 60, 60 . . . provided at the inner circumference thereof engage with engaging teeth 61, 61 . . . provided at the rear outer circumference of the second internal gear 16. Whereby, the rotation of the second internal gear 16 is regulated irrespective of biasing force of the coil spring 50. At the outer circumference of the clutch switching lever 57, a pair of connecting projections 62, 62 as a connecting body is symmetrically disposed about a point in the radial direction. The connecting projections 62, 62 penetrate through slits 63, 63 as a restricting slit formed in the gear case 12 in the axial direction so as to protrude outside of the gear case 12.

Figure 5A:
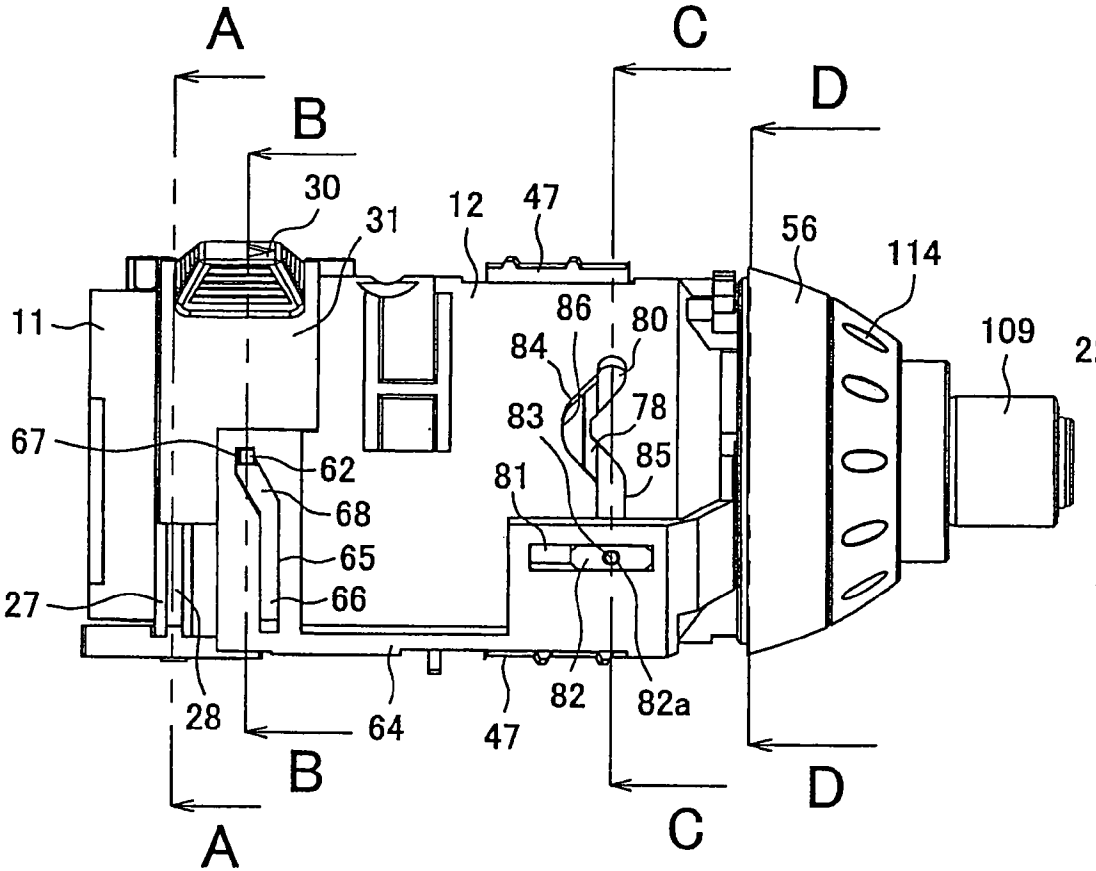
FIG. 5A is a side view of a gear case portion.

At the outer circumference of the gear case 12, a semi-cylindrical switching case 64 with a slight larger diameter than the gear case 12 is externally provided so as to be rotatable. The switching case 64 has a rear notch portion in which a switching plate 31 is fitted. Consequently, in accordance with sliding movement of the switching plate 31 in the circumferential direction, the switching case 64 rotates integrally with the switching plate 31. The switching case 64 and the switching plate 31 serve as a common switching member. At the rear end portion of the switching case 64, a pair of clutch switching grooves 65, 65 symmetrically disposed about a point is formed to which the connecting projection 62 of the clutch switching lever 57 is inserted respectively. As shown in FIG. 5A, each clutch switching groove 65 has a first groove 66 extending along the circumference of the switching case 64, a second groove 67 located behind the first groove 66 by a predetermined distance and extending along the circumference of the switching case 64, and an inclined groove 68 connecting the first groove 66 and the second groove 67. Here, the connecting projection 62 is regulated its movement in the circumferential direction by a slit 63. The connecting projection 62 is moved in the clutch switching groove 65 in accordance with rotation of the switching case 64, thereby operation of the clutch switching lever 57 for moving back and forth can be conducted from outside through the connecting projection 62. The clutch switching lever 57 is at a forward position when the connecting projection 62 is located at the first groove 66 (a first sliding position), and the clutch switching lever 57 is at a backward position when the connecting projection 62 is located at the second groove 67 (a second sliding position).

The impact mechanism 6 includes an anvil 8 axially supported by a small cylindrical portion 12*a* provided at the front of the gear case 12 and the hammer case 56 through ball bearings 69, 69, a spindle 18 inserted coaxially into the rear of the anvil 8 with play, a hammer 70 externally provided on the spindle 18, and a coil spring 72 whose rear end is received by a cap washer 71 which is fitted on the spindle 18 for pressing the hammer 70 forward. As shown in FIG. 6B, the hammer 70 is connected with the spindle 18 by two steel balls 75, 75 inserted so as to straddle both a pair of V-shaped cam grooves 73, 73 formed at the outer circumference of the spindle 18 and connecting grooves 74, 74 formed at the inner circumference of the hammer 70 in the axial direction. The hammer 70 is biased by a coil spring 72 to a forward position where the steel ball 75 is positioned at the front end of the cam groove 73 (that is, the front end of the V-groove) and the rear end of the connecting groove 74. At the front surface of the hammer 70, a pair of engaging portions 77, 77 having a quarter sector shape seen from the front for engaging with a pair of arms 76, 76 extending radially at the rear end of the anvil 8. At the forward position of the hammer 70 as shown in FIG. 1, the engaging portions 77, 77 engage with the arms 76, 76 to rotate the hammer 70 and the anvil 8 integrally.

An auxiliary ring 78 is externally provided on the hammer 70 for serving as a releasing means for the impact mechanism 6 of the present invention. The auxiliary ring 78 has a pair of chamfered surfaces to be rotatable integrally with the hammer 70 as well as movable independently in the axial direction. On the front surface of the auxiliary ring 78, curved auxiliary engaging portions 79, 79 are projecting so as to be attached to the engaging portions 77, 77 of the hammer 70. At a forward position, the auxiliary engaging portions 79, 79 together with the engaging portions 77, 77 of the hammer 70 engage with the arms 76, 76. At the outer circumference of the auxiliary ring 78, a concave groove 80 is provided in the circumferential direction. In the switching case 64, rectangular guide bodies 82, 82 (an impact switching member) having a cylindrical body 82*a* in its center are provided so as to be movable back and forth in a pair of slits 81, 81 (a restricting slit) formed in the axial direction. As shown in FIGS. 5A and 6B, a stepped pin 83 (a connecting body) inserted into the cylindrical body 82*a* of each guide body 82 penetrates a pair of impact switching grooves 84, 84 formed on the gear case 12, and the top of the stepped pin 83 is inserted with play into the concave groove 80 of the auxiliary ring 78.

The impact switching groove 84 consists of a first groove 85 formed in the circumferential direction of the gear case 12 and a second groove 86 bent in a V shape from the end of the first groove 85. In accordance with rotation of the switching case 64, the stepped pins 83, 83 together with the guide bodies 82, 82 regulated its circumferential movement in the slits 81, 81 are moved in the impact switching grooves 84, 84. As a result, the auxiliary ring 78 is moved back and forth from outside through the stepped pin 83. When the stepped pin 83 is positioned in the first groove 85 and the guide body 82 is at a forward position, the auxiliary ring 78 is at a forward position (a first sliding position). On the other hand, when the stepped pin 83 is positioned at the summit of the V-shaped second groove 86 and the guide body 82 is at a backward position, the auxiliary ring 78 is at a backward position (a second sliding position). In the impact switching groove 84, the cylindrical body 82*a* externally provided on the stepped pin 83 is slid with the guide body 82. This dual structure of the cylindrical body 82*a* and the stepped pin 83 ensures to enhance the mechanical strength of the stepped pin 83. As a result, the stepped pin 83 can slide in the impact switching groove 84, so that the auxiliary ring 78 can be moved without fail.

In the hammer case 56, the percussion mechanism 7 is provided. The percussion mechanism 7 has a first cam 87, a second cam 90, and a percussion switching lever 93 (a percussion switching member). The first cam 87 is integrally fitted on the anvil 8 between the ball bearings 69, 69. The second cam 90 is externally provided on the anvil 8 at the rear of the first cam and regulated its backward movement by balls 88, 88 . . . and a flat washer 89. The percussion switching lever 93 is in a ring shape and provided in the small cylindrical portion 12*a* of the gear case 12 at the rear of the second cam 90. The percussion switching lever 93 has engaging teeth 92, 92 . . . at the front end thereof for engaging with engaging teeth 91, 91 . . . formed at the outer circumference of the second cam 90. The first cam 87 and the second cam 90 have cam teeth 94, 94 . . . and 95, 95 . . . on opposing surfaces thereof respectively for engaging with each other when they are contacted. The second cam 90 and the percussion switching lever 93 serve as a releasing means of the percussion mechanism 7.

Figure 7:
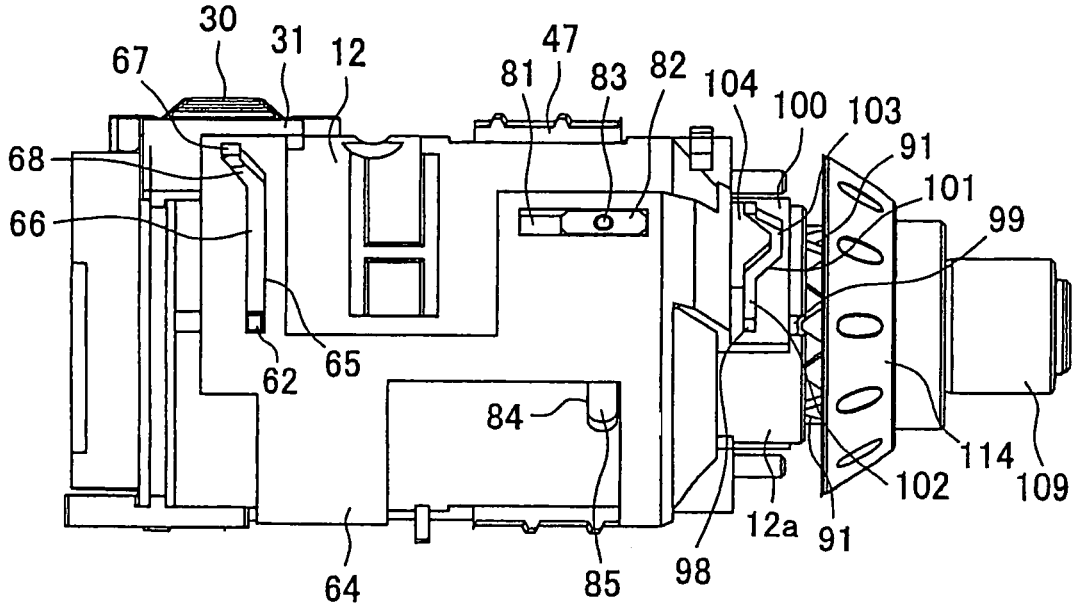
In FIG. 7, the upper figure is a lateral view of a gear case portion in a drill mode, and the lower figure is a vertical section view (a change ring and a hammer case are also shown).
Figure 7:
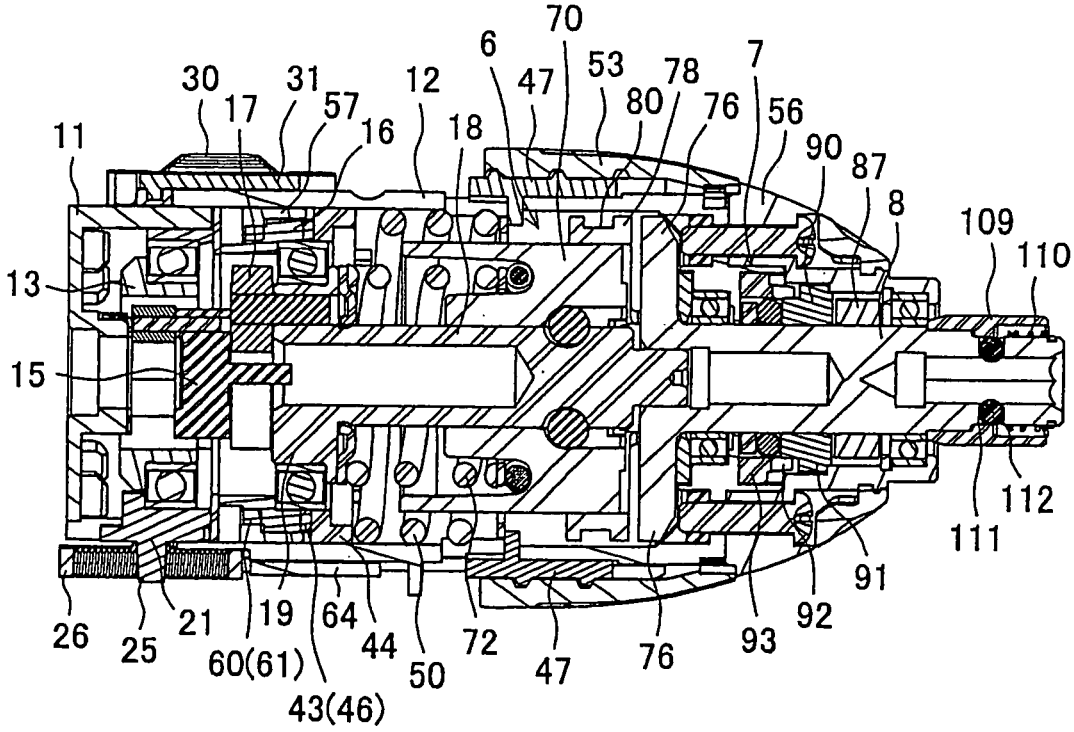

As shown in FIG. 6C, the percussion switching lever 93 is held in the small cylindrical portion 12*a* so as to be movable back and forth and regulated its rotation by engagement between projections 96, 96 . . . provided at the outer circumference and concave portions 97, 97 . . . provided on an inner surface of the small cylindrical portion 12*a*. Moreover, a pair of connecting projections 98, 98 (a connecting body) is radially provided at the outer circumference between the projections 96, 96 . . . in order to penetrate slits 99, 99 (a restricting slit) provided in the small cylindrical portion 12*a*. The connecting projections 98, 98 are inserted with play into a pair of curved guide plates 100, 100 provided at the front end of the switching case 64. As shown in FIG. 7, in order to insert the connecting projection 98 with play in each guide plate 100, a percussion switching groove 101 is provided which is constituted by a first groove 102 along the circumference direction of the switching case 64 and a second groove 103 bent forward in a trapezoidal shape from the end of the first groove 102. In accordance with rotation of the switching case 64, the connecting projections 98, 98 regulated its circumferential movement in the slits 99, 99 are moved in the percussion switching grooves 101, 101, thereby moving the percussion switching lever 93 back and forth from outside through the connecting projections 98, 98. When the connecting projection 98 is positioned in the first groove 102, the percussion switching lever 93 is at a backward position (a first sliding position). On the other hand, when the connecting projection 98 is positioned at the summit of the trapezoidal second groove 103, the percussion switching lever 93 is at a forward position (a second sliding position).

In this embodiment, the switching case 64 is made of synthetic resin. Therefore, stainless steel plates 104, 104 are separately provided for a portion including the rear end of the second groove 103 on the guide plate 100 in order to improving strength of the percussion switching groove 101.

Next, rotative positions of the switching case 64 which can be changed by the operation of the switching button 30 and operation modes obtained with the same will be explained.

As shown in FIG. 7, when the switching button 30 is at a first position being located at the left end of the window 32 (In FIG. 4, it is the upper side. Hereinafter, the direction of anvil 8 is the front side.), the switching case 64 is at a first rotative position. With this position, in the clutch switching groove 65, the connecting projection 62 of the clutch switching lever 57 is positioned at the right end of a first groove 66. Consequently, the clutch switching lever 57 is located at the forward position to regulate the rotation of the second internal gear 16. In the impact switching groove 84, the stepped pin 83 is located at the left end of the first groove 85. Thus, the auxiliary ring 78 is at a forward position and engages with the arm 76. Moreover, in the percussion switching groove 101, the connecting projection 98 is located at the right end of the first groove 102. Thus, the percussion switching lever 93 is at a backward position and separated from the second cam 90.

Therefore, the second internal gear 16 is directly prevented from idling by the clutch switching lever 57, so that a drill mode is selected in which the anvil 8 rotates integrally with the spindle 18 through the auxiliary ring 78. Here, the second cam 90 is freely rotatable, so that the percussion does not occur even if the second cam 90 abuts to the first cam 87.

Figure 8:
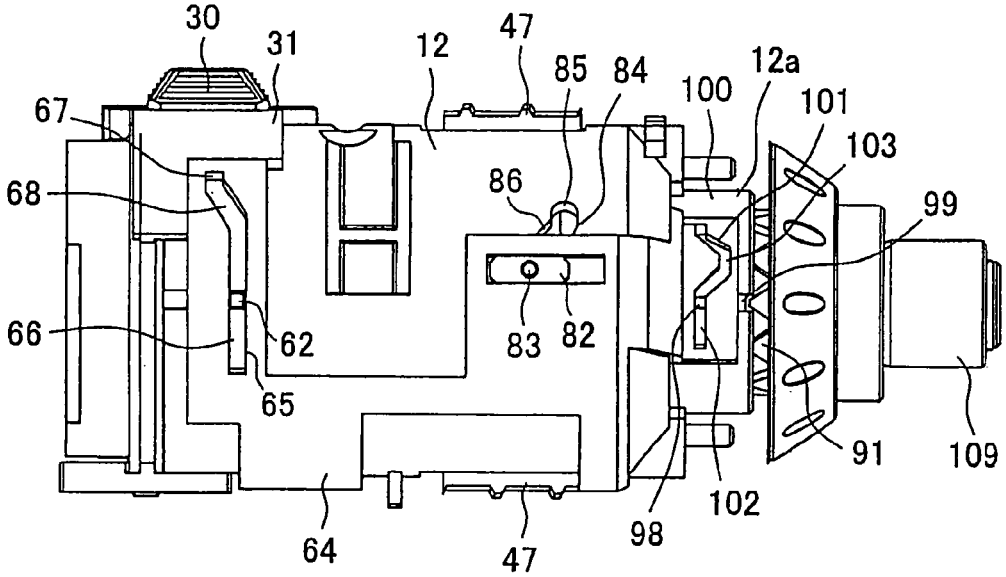
In FIG. 8, the upper figure is a lateral view of a gear case portion in an impact mode, and the lower figure is a vertical section view (the change ring and the hammer case are also shown).
Figure 8:
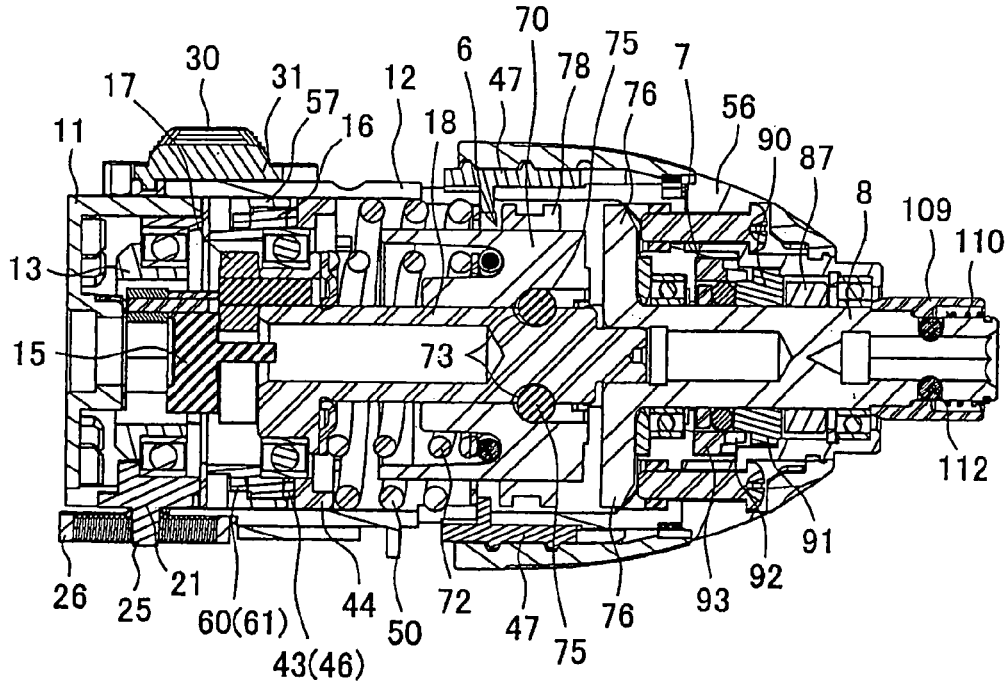

Next, as shown in FIG. 8, when the switching button 30 is moved to the right from the first position by approximately one-third of the transverse length of the window 32, the switching case 64 is at a second rotative position. With this position, in the clutch switching groove 65 and the percussion switching groove 101, the forward position of the clutch switching lever 57 and the backward position of the percussion switching lever 93 are maintained because the connecting projections 62, 98 are still within the first grooves 66, 102. However, in the impact switching groove 84, the stepped pin 83 is inserted into the second groove 86 and moved to the summit of the V-groove. Therefore, the auxiliary ring 78 moves backward and is separated from the arm 76.

Therefore, at a second position of the switching button 30, an impact mode is selected in which no percussion occurs, because the second internal gear 16 is prevented from idling regardless of a load on the anvil 8 and the second cam 90 is freely rotatable while the spindle 18 and the anvil 8 are connected through the hammer 70.

Figure 9:
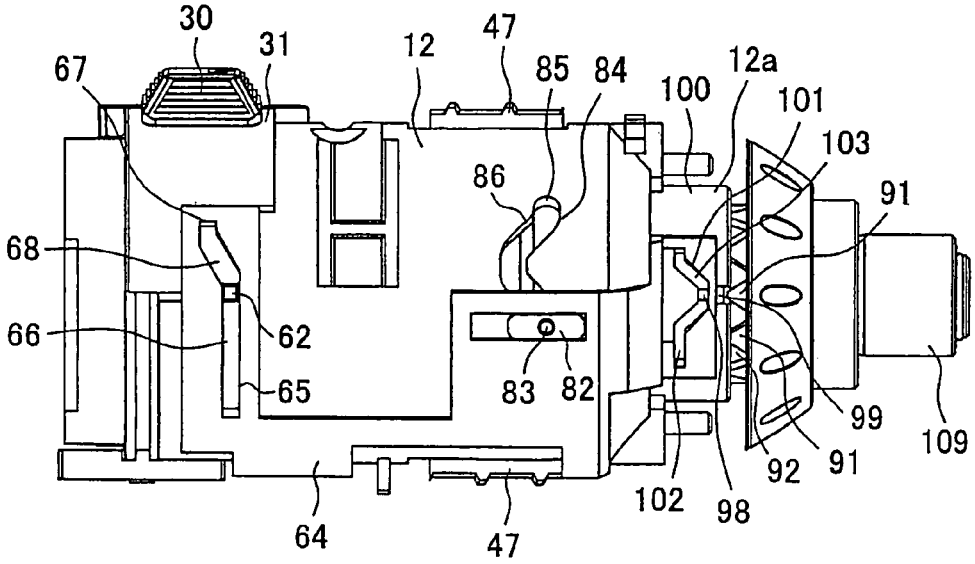
In FIG. 9, the upper figure is a lateral view of a gear case portion in a percussion drill mode, and the lower figure is a vertical section view (the change ring and the hammer case are also shown).
Figure 9:
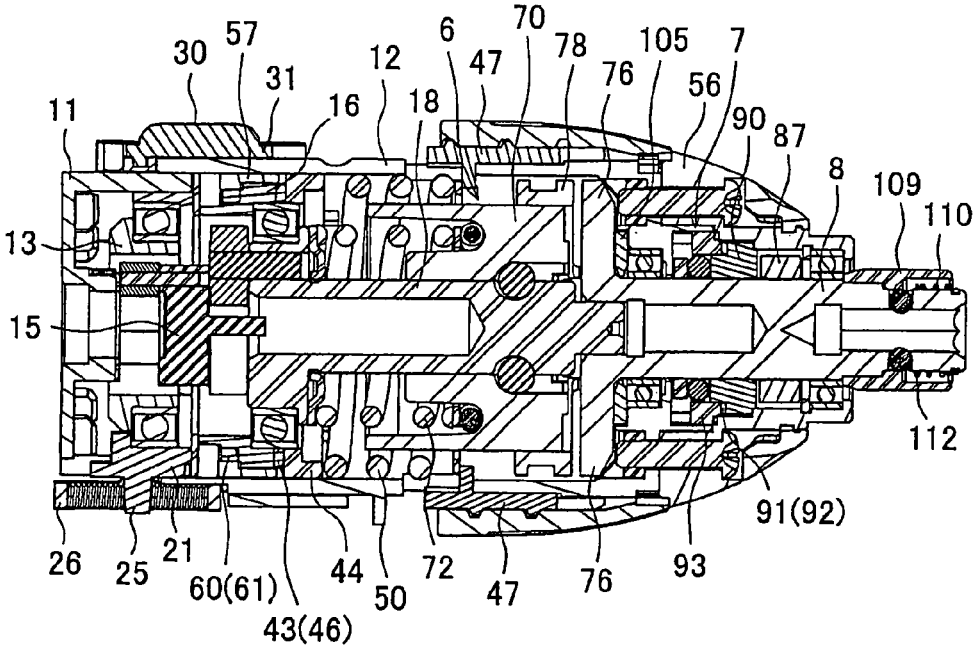

Next, as shown in FIG. 9, when the switching button 30 is moved to the right from the second position by approximately one-third of the transverse length of the window 32, the switching case 64 is at a third rotative position. With this position, in the clutch switching groove 65 the connecting projection 62 is still in the first groove 66. However, in the impact switching groove 84, the stepped pin 83 is inserted into the first groove 85 again to move the auxiliary ring 78 to the forward position. Moreover, in the percussion switching groove 101, the connecting projection 98 is inserted into the second groove 103 to move to the summit of the trapezoidal shape. Therefore, the percussion switching lever 93 moves forward to regulate the rotation of the second cam 90.

Consequently, at a third position of the switching button 30, the second internal gear 16 is prevented from idling irrespective of the load on the anvil 8, and the anvil 8 rotates integrally with the spindle 18. The anvil 8 is accommodated so as to be slightly movable back and forth between a forward position where the front ends of the arms 76, 76 abut to a nylon washer 105 which is held by the small cylindrical portion 12*a* of the gear case 12 and which is externally provided at the anvil 8, and a backward position where the rear ends of the arms 76, 76 abut to a step portion at the front end of the spindle 18. Because of this, at the backward position of the anvil 8, a percussion drill mode is selected in which the first cam 87 rotating with the anvil 8 abuts to the second cam 90 regulated its rotation by the percussion switching lever 93.

Figure 10:
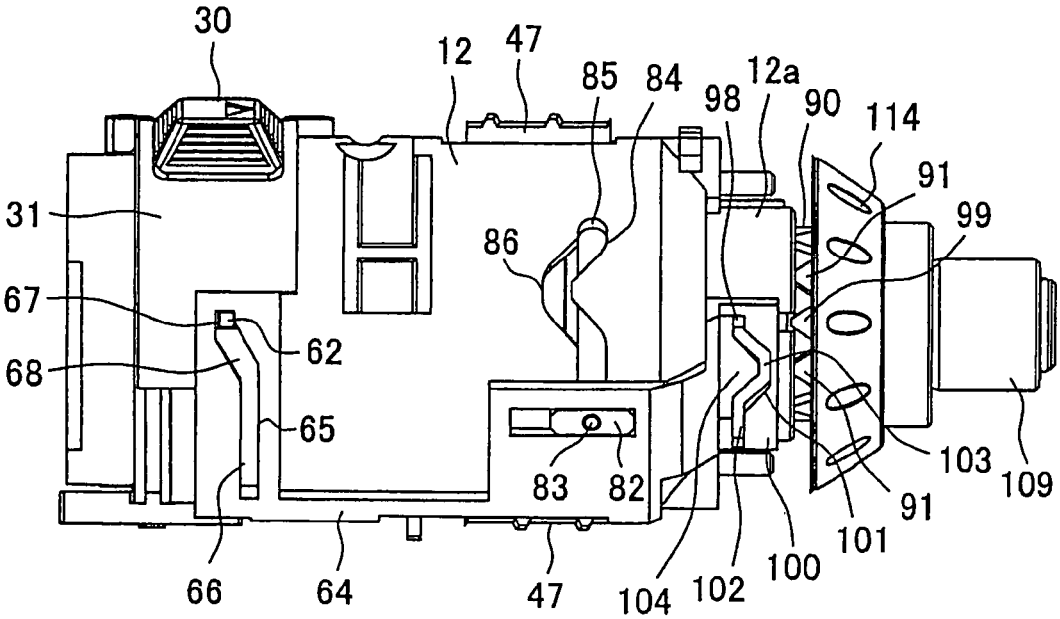
In FIG. 10, the upper figure is a lateral view of a gear case portion in a clutch mode, and the lower figure is a vertical section view (the change ring and the hammer case are also shown).
Figure 10:
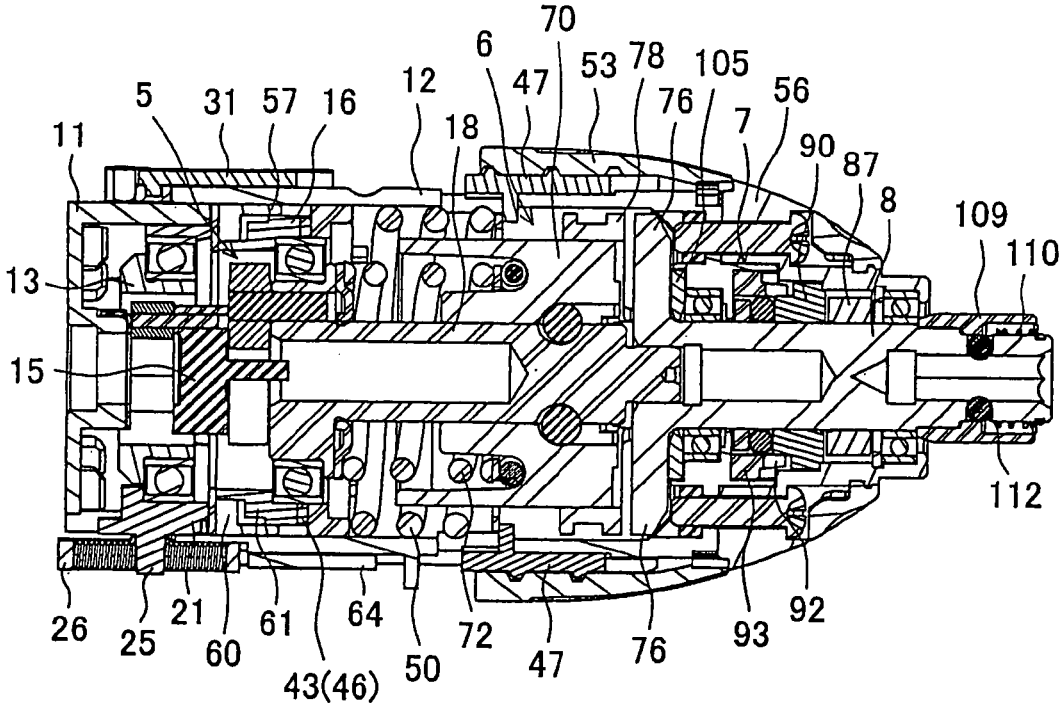

As shown in FIG. 10, when the switching button 30 is located at the right end of the window 32, the switching case 64 is at a fourth rotative position. With this position, in the clutch switching groove 65, the connecting projection 62 is moved into the second groove 67 guided by the inclined groove 68 to move the clutch switching lever 57 backward. In the impact switching groove 84, as the stepped pin 83 is located at the right end of the first groove 85, the auxiliary ring 78 is still remained at the forward position. However, in the percussion switching groove 101, the connecting projection 98 is moved backward again from the second groove 103 and moves to the left end of the first groove 102. Therefore, the percussion switching lever 93 moves backward to disengage from the second cam 90.

Consequently, at a fourth position of the switching button 30, no impact occurs since the anvil 8 rotates integrally with the spindle 18 and no percussion occurs since the second cam 90 is freely rotatable. With this position, a clutch mode is selected where the second internal gear 16 is locked only by the biasing force of the coil spring 50 because the clutch switching lever 57 is moved backward.

As shown in FIGS. 3 and 6A, the switching button 30 accommodates a steel ball 106 with a coil spring 107 pressing the steel ball 106 to the inner surface of the switching plate 31. On the outer surface of the gear case 12, concave portions 108, 108 . . . corresponding to four sliding positions of the switching button 30 is provided aligning back and forth in two rows. With this structure, when the switching button 30 is slid, clicking operation in accordance with each operation mode and speed switching position can be obtained.

On the other hand, at the front outer circumference of the anvil 8, a chuck sleeve 109 is provided so as to be movable back and forth with a predetermined stroke in the axial direction. The chuck sleeve 109 is pressed to a backward position where it abuts to the inner ring of the ball bearing 69 provided at the front by a coil spring 110 externally provided on the anvil 8 at the front of the chuck sleeve 109. At the backward position, a projection 111 provided at the inner circumference of the chuck sleeve 109 presses balls 112, 112, serving as a pressing member and inserted so as to be radially movable in the anvil 8, toward the center of axle. Then the balls 112, 112 are made to protrude into an attaching hole 113 provided at the center of axle of the anvil 8 and having a hexagonal section so as to receive and fix a bit (not shown) to be inserted into the attaching hole 113. When the chuck sleeve 109 is slid forward against the biasing force of the coil spring 110, the balls 112, 112 pressed by the projection 111 are released, whereby the bit can be attached to or detached from the attaching hole 113.

In particular, as the chuck sleeve 109 pressed backward abuts to the ball bearing 69, in a normal state the anvil 8 is at a forward position biased by a coil spring 110 to maintain a state in which the first cam 87 and the second cam 90 do not contact with each other. When the bit attached to the anvil 8 is pushed on the head of a screw etc., the anvil 8 is moved backward and the cam teeth 94 and 95 of the first and second cams 87, 90 contact each other.

When the anvil 8 is moved backward, the chuck sleeve 109 abutting to the ball bearing 69 relatively moves forward. However, the moving distance of the chuck sleeve 109 is negligible and the pressing state to the balls 112, 112 is unchanged, so that fixing of the bit is maintained.

In the above-structured impact driver 1, the drill mode as shown in FIG. 7 is selected by sliding the switching button 30 to the first position. In the drill mode, the trigger 10 is pressed to turn ON the switch 9, and the motor 3 is driven to rotate the motor shaft 4. The rotation speed of the motor shaft 4 is reduced through the planetary gear reduction mechanism 5 and transmitted to the spindle 18. The spindle 18 is connected to the anvil 8 by not only the hammer 70 but also the auxiliary ring 78 positioned at a forward position. Because of this, the anvil 8 always rotates with the spindle 18, resulting that impact does not occur in the impact mechanism 6. In the percussion mechanism 7, since the percussion switching lever 93 is free, percussion does not occur even when the anvil 8 is moved backward. Therefore, boring can be conducted using a drill bit and the like attached to the anvil 8. In this case, the second internal gear 16 is regulated its rotation by the clutch switching lever 57, so that the clutch mechanism is stopped, that is, the anvil 8 continues to rotate irrespective of a load on the same.

When the switching button 30 is slid to the second position, the impact mode is selected as shown in FIG. 8. In the impact mode, the switch 9 is turned ON and rotation of the spindle 18 is transmitted to the anvil 8 through the hammer 70. Then, screwing with the driver bit attached on the anvil is performed. When the screwing proceeds to a state in which a load on the anvil 8 increases, the steel balls 75, 75 are rolled backward along the cam grooves 73, 73 of the spindle 18. Consequently, the hammer 70 is moved backward against the biasing force of the coil spring 72 until it disengages from the arms 76, 76 of the anvil 8. However, at the moment when the engaging portions 77, 77 disengage from the arms 76, 76, the hammer 70, which is rotating with the spindle 18, immediately moves forward again being pressed by the coil spring 72 until the engaging portions 77, 77 engage with the arms 76, 76. These disengagement and reengagement of the hammer 70 with respect to the anvil 8 are mechanically repeated, which leads to the intermittent impact operation to the anvil 8. In this way, tight screwing can be conducted. Similar to the drill mode, percussion does not occur in the percussion mechanism 7 and the clutch mechanism is stopped because the second internal gear 16 is locked.

Next, when the switching button 30 is slid to the third position, the percussion drill mode as shown in FIG. 9 is selected. In the percussion drill mode, when the switch 9 is turned ON, the hammer 70 and the anvil 8 are connected by the auxiliary ring 78. Consequently, the impact does not occur in the impact mechanism 6 and the clutch mechanism is stopped because the second internal gear 16 is locked. However, in the percussion mechanism 7, the rotation of the second cam 90 is regulated by the percussion switching lever 93. Because of this, when the anvil 8 is moved backward by being pressed by the drill bit and the like, the first cam 87 rotating integrally with the anvil 8 abuts to the second cam 90. As a result, the percussion in the axial direction occurs to the anvil 8 because the cam teeth 94, 95 interfere with each other.

Next, when the switching button 30 is slid to the fourth position, the clutch mode is selected. In the clutch mode, when the switch 9 is turned ON, the connecting status between the hammer 70 and the anvil 8 through the auxiliary ring 78 is still maintained, so that the impact does not occur in the impact mechanism 6. In the percussion mechanism 7, since the second cam 90 is freely rotatable, percussion does not occur even when the anvil 8 is moved backward. However, in the planetary gear reduction mechanism 5, the rotation of the second internal gear 16 which is regulated by the clutch switching lever 57 is released. With this mechanism, when screwing proceeds to the state in which a load on the anvil 8 and the spindle 18 exceeds the pressing by the coil spring 50, the engaging projection 43 of the second internal gear 16 pushes the pressing ring 44 forward until the engaging projection 43 and the engaging projection 46 pass each other. As a result, the second internal gear 16 idles, thereby ending screwing. The clutch operation torque can be adjusted by changing the contraction status of the coil spring 50 in accordance with rotative operation of the change ring 53.

In each operation mode mentioned above, the switching plate 31 is usually slid to right and left at a forward position guided by the switching button 30 in the window 32. Consequently, the first internal gear 13 together with the speed switching ring 21 is freely rotatable at a forward position, whereby the anvil 8 rotates in a high speed mode in which the planetary gear 14 and the carrier 15 are connected.

Further, the switching button 30 can be moved backward only at the first position. In this case, the internal gear 13 together with the speed switching ring 21 is moved backward to be regulated its rotation, whereby it engages with only the planetary gear 14. Therefore, the anvil 8 rotates in a slow mode. In this way, switching of high speed/slow rotation of the anvil 8 can be conducted only in the drill mode.

As described above, in the impact driver 1 in accordance with the above embodiment, the switching plate 31 and the switching case 64 are provided in the housing for engaging with the clutch switching lever 57 and the guide body 82 simultaneously and moving them in accordance with rotation to a predetermined position so that combination of each sliding position is changed. Then the switching plate 31 and the switching case 64 are rotated by the switching button 30 from the outside of the housing. Accordingly, any of the impact mode, the clutch mode, and the drill mode can be selected respectively. This means that any of all operation modes can be selected by using one switching button 30, so that malfunction can be prevented and excellent operability and reliability can be achieved.

In addition, the percussion switching lever 93 is provided for switching percussion operation and its release to be engaged with the switching case 64. By rotating the switching case 64 to combine the sliding positions of the switching lever 93, the percussion drill mode can be further selected.

Accordingly, operability is not lowered even if the percussion drill mode is added, so that an excellent operability is maintained.

Moreover, the speed is switched in the drill mode by indirectly engaging the speed switching ring 21 with the switching plate 31 through the speed switching lever 27, and the sliding positions of the speed switching ring 21 is combined by moving the speed switching plate 31 back and forth. In this way, speed is also switched with the switching button 30, whereby more excellent operability can be expected.

Moreover, the common switching member 64 consists of the switching case 64 with which each switching member is moved. For this moving, there are provided unidirectional slits 63, 81, 99 provided at either the gear case 12 or the switching case 64, the switching grooves 65, 84, 101 provided at the other thereof, and the connecting projections 62, 98 and the stepped pin 83 which are provided at either the switching case 64 or any of the switching members for sliding the switching member guided by the switching groove in accordance with rotation of the switching case 64. Therefore, it is possible to guide each switching member to each sliding position smoothly without fail.

According to the impact driver 1 in the above embodiment, the coil spring 110 is set to press the chuck sleeve 109 so as to be slid backward and at the sliding position the chuck sleeve 109 is caused to abut to the ball bearing 69 on the side of the main body, resulting that the anvil 8 is biased to the forward position by the coil spring 110. In this way, biasing of the anvil 8 to a forward position as well as the chuck sleeve to a backward position can be achieved by using only one coil spring 110 provided with the chuck sleeve 109, which reduces the number of parts and achieves an efficient structure. Therefore, the trouble of assembly can be saved and the manufacture cost can be reduced.

It should be noted that the shape etc. of the switching member, the common switching member, the restricting slit, the switching groove, the connecting body and the like is not limited to the above embodiment and can be changed arbitrarily. For example, such a modification is feasible that the restricting slit provided with the gear case and the switching groove provided with the switching case are provided inversely, the bulging direction of the V-shape or the trapezoidal shape of the switching groove may be opposite so that the sliding direction of the switching member is changed, and the like. In particular, the switching member and the common switching member are not directly engaged, but indirectly engaged through other members. Moreover, the switching member may consist of a plurality of members.

Moreover, the impact mechanism is not limited to a structure in which the hammer engages with or disengages from the anvil in the above embodiment. For example, it is acceptable to adopt a well-known impact structure utilizing an oil unit which includes a case and a spindle. In this oil unit, speed difference between the case of the input side and the spindle of the output side leads to pressure of an oil room provided with the case, which generates intermittent impact to the spindle in the rotative direction. In this impact structure, a switching means can be similarly slid by the common switching means of the present invention as long as an impact releasing means to switch engagement and disengagement between the case and an output shaft is provided.

Further, in the above embodiment, an impact driver is explained in which any of the four operation modes, which are, the drill mode, the impact mode, the percussion drill mode, and the clutch mode is selectable. However, these four operation modes are not necessarily provided, and other electric power tools are acceptable, for example, an electric power tool in which at least any of the impact mode, the clutch mode, and the drill mode is selectable (corresponding to the first aspect of the present invention), or an electric power tool in which at least any of the impact mode, the drill mode, and the percussion drill mode is selectable (corresponding to the third aspect of the present invention). Accordingly, the percussion drill mode is unnecessary in the former case, and the clutch mode is unnecessary in the latter case.

On the other hand, in the above embodiment only in the drill mode the switching button is moved backward to obtain the slow mode. However, also in the other operation modes, in all or any thereof, any of the slow mode and the high speed mode may be selectable by moving the switching button backward. In addition, in the above embodiment speed is switched by moving the switching plate back and forth to slide the speed switching means to a front or back position. Besides the above, when speed is switched in any of the operation modes only, sliding of the speed switching member is achieved by a restricting slit provided at either the gear case or the switching case, a switching groove provided at the other thereof, and a connecting body provided either the switching case or the switching member as in the other operation modes.

Needless to say, the present invention can be applied to an electric power tool without the speed switching mechanism. In such a case, it is unnecessary to form the common switching member by the switching plate for moving back and forth and a switching case for rotating only, and thus one member incorporating the switching plate into the switching case is sufficient.

Besides the coil spring, the biasing means to the chuck sleeve can be constituted by other members such as a plate spring or an elastic body or combination thereof. Moreover, the abutment position of the chuck sleeve to the side of the housing is not limited to the ball bearing, and other positions such as the hammer case or the washer may be applicable. In addition, a roller etc. in addition to the ball can be adopted as the pressing member.

What is claimed is:

1. An electric power tool comprising:

a housing;

a motor;

a planetary gear reduction mechanism which transmits output of the motor to an output shaft protruding from a front side of the housing;

an impact mechanism which applies an intermittent impact to the output shaft in a rotative direction;

a releasing means which selectively releases the impact to the output shaft applied by the impact mechanism;

a percussion mechanism which applies percussion to the output shaft in the axial direction;

a second releasing means which selectively releases percussion to the output shaft by the percussion mechanism;

an impact switching member which is slidable between a first sliding position to release impact by the impact mechanism with the operation of the releasing means, and a second sliding position to apply impact by the impact mechanism without the operation of the releasing means;

a percussion switching member which is slidable between a first sliding position to release percussion by the percussion mechanism with the operation of the second releasing means, and a second sliding position to apply percussion by the percussion mechanism without the operation of the second releasing means; and a common switching member which simultaneously engages with both the impact switching member and the percussion switching member to slide them when the common switching member is moved to a predetermined position, whereby combination of the above sliding positions is changeable, wherein by moving the common switching member located outside of the housing, one operation mode is selectable among the following:

an impact mode where impact is applied by the impact mechanism and percussion by the percussion mechanism is released simultaneously;

a drill mode where impact operation by the impact mechanism is released and percussion by the percussion mechanism is released simultaneously, and a percussion drill mode where impact by the impact mechanism is released and percussion is applied by the percussion mechanism simultaneously.

* * * * *